US009540141B2

(12) United States Patent
Kurz et al.

(10) Patent No.: US 9,540,141 B2
(45) Date of Patent: Jan. 10, 2017

(54) PACKING CARTON AND RELATED MACHINE AND METHOD

(71) Applicant: INDAG Gesellschaft für Industriebedarf mbH & Co. Betriebs KG, Eppelheim (DE)

(72) Inventors: Michael Kurz, Mühlhausen (DE); Wolfgang Embach, Heddesheim (DE)

(73) Assignee: INDAG GESELLSCHAFT FUR INDUSTRIEBEDARF MBH & CO. BETRIEBS KG, Eppelheim (DE)

( * ) Notice: Subject to any disclaimer, the term of this patent is extended or adjusted under 35 U.S.C. 154(b) by 216 days.

(21) Appl. No.: 13/705,520

(22) Filed: Dec. 5, 2012

(65) Prior Publication Data

US 2013/0140352 A1 Jun. 6, 2013

(30) Foreign Application Priority Data

Dec. 5, 2011 (EP) ..... 11191871

(51) Int. Cl.
*B65D 25/00* (2006.01)
*B65B 5/02* (2006.01)
(Continued)

(52) U.S. Cl.
CPC ..... *B65D 25/00* (2013.01); *B65B 5/02* (2013.01); *B65B 5/04* (2013.01); *B65B 7/16* (2013.01);
(Continued)

(58) Field of Classification Search
CPC ..... B65B 7/16; B65B 7/20; B65B 7/26; B65B 51/023; B65B 2220/04; B65B 2220/02; B65B 5/024; B65D 5/0085; B65D 77/062
(Continued)

(56) References Cited

U.S. PATENT DOCUMENTS 1,492,902 A * 5/1924 Smith ..... 493/68
2,977,861 A * 4/1961 Gibb ..... 493/171
(Continued)

FOREIGN PATENT DOCUMENTS

EP 0909706 A1 4/1999
FR 1347824 A 1/1964
(Continued)

OTHER PUBLICATIONS

Office Action issued on Nov. 27, 2013 in Korean Patent Application No. 10-2012-0138945.
(Continued)

*Primary Examiner* — Gloria R Weeks
(74) *Attorney, Agent, or Firm* — Stroock & Stroock & Lavan, LLP

(57) ABSTRACT

A packing carton for packing pouch-type beverage containers stands on two sides, referred to as bottom surfaces, while in the open state and comprises halves which are open at their respective tops. Each bottom surface is delimited on four sides by carton sides, and the halves have a common longitudinal side, which is bent in the middle when in the open state, and comprises stiffening flaps on the transverse sides. The stiffening flaps are extensions on the transverse sides. A machine for closing such a packing carton is also disclosed, as well as a related method for closing the packing carton.

12 Claims, 7 Drawing Sheets

(51) Int. Cl.

| | |
|---|---|
| ***B65D 77/06*** | (2006.01) |
| ***B65D 5/00*** | (2006.01) |
| ***B65D 5/44*** | (2006.01) |
| ***B65B 51/02*** | (2006.01) |
| ***B65B 5/04*** | (2006.01) |
| ***B65B 7/16*** | (2006.01) |

(52) U.S. Cl.
CPC ..... *B65B 51/023* (2013.01); *B65D 5/0085* (2013.01); *B65D 5/443* (2013.01); *B65D 77/062* (2013.01)

(58) Field of Classification Search
USPC ..... 53/484, 491, 285, 476, 209, 233, 377.2, 53/462, 387.2; 493/68, 69, 79, 127, 140
See application file for complete search history.

(56) References Cited

U.S. PATENT DOCUMENTS

| | | | | |
|---|---|---|---|---|
| 3,137,112 | A * | 6/1964 | Kulleseid | B65B 7/20 53/377.3 |
| 3,267,637 | A * | 8/1966 | Baker | 53/484 |
| 3,443,353 | A * | 5/1969 | Di Vecchio | 53/484 |
| 3,884,013 | A * | 5/1975 | Solomon | B65B 5/06 53/158 |
| 3,981,122 | A * | 9/1976 | Johnson | 53/376.5 |
| 3,981,123 | A * | 9/1976 | Flanagan | 53/376.5 |
| 4,424,658 | A * | 1/1984 | Focke | B65B 5/068 53/158 |
| 4,581,876 | A * | 4/1986 | Williams et al. | 53/484 |
| 4,659,016 | A * | 4/1987 | Faulkner, III | 239/135 |
| 5,024,045 | A * | 6/1991 | Fluent et al. | 53/443 |
| 5,379,573 | A * | 1/1995 | Greenwell | B65B 51/023 53/376.5 |
| 7,322,171 | B2 * | 1/2008 | Bonnain | B65B 5/061 53/209 |

FOREIGN PATENT DOCUMENTS

| | | |
|---|---|---|
| FR | 2043987 A5 | 2/1971 |
| FR | 2899880 A1 | 10/2007 |

OTHER PUBLICATIONS

Notice of Examination Opinion issued on Jul. 31, 2015 in Taiwanese Patent Application No. 101142483.
First Office Action issued on May 26, 2014 in Chinese Patent Application No. 201210514816.7.
Second Office Action issued on Dec. 15, 2014 in Chinese Patent Application No. 201210514816.7.
Office Action issued on May 16, 2014 in Korean Patent Application No. 10-2012-0138945.
Office Action issued on Dec. 3, 2013 in Japanese Patent Application No. 2012-252398.
Office Action issued on Dec. 10, 2013 in Canadian Patent Application No. 2,795,779.

* cited by examiner

PACKING CARTON AND RELATED MACHINE AND METHOD

CROSS-REFERENCE TO RELATED APPLICATIONS

This application claims the benefit of European Patent Application No. 11191871.0, filed on Dec. 5, 2011, the contents of which are incorporated herein by reference.

BACKGROUND OF THE INVENTION

1. Field of the Invention

The invention relates to a packing carton for packing pouch-type beverage containers, to a machine for closing a packing carton and to a method for closing a packing carton.

2. Description of the Related Art

The packing of individual containers, in particular of individual, pouch-type containers in cartons or other packing alternatives, e.g. for dispatch, transport and storage, hereinafter termed "packing cartons," is known from the prior art. Such packing cartons are often made of corrugated cardboard or, like packing cases, are reinforced in certain areas by two layers of cardboard provided in parts. The packing of containers using machines for the packing carton is known as well.

A reinforced carton is known from European Patent No. EP2013093 B1. Document G9420577 discloses a packing carton made, in particular, of cardboard and having a closure made of cardboard. German Patent No. DE19745854 C1 discloses a method and a device for packing bags in packing cartons.

However, the prior art solutions suffer from the problem that, for stability reasons, non-corrugated cardboard can sometimes not be used without an additional reinforcement, e.g. by double layers. This leads to higher materials costs and increased complexity, which should preferably be avoided.

Also, it should be possible to carry out a packing method as efficiently and fast as possible, and it should be tailored to the packing carton.

SUMMARY OF THE INVENTION

An object of various embodiments of the invention is to provide an improved packing carton, an improved machine for closing a packing carton as well as an improved method for closing a packing carton.

A packing carton according to an embodiment of the invention is used for packing pouch-type beverage containers, and which stands on two sides, referred to as bottom surfaces, in the open state. The packing carton comprises two halves which are open at the top. The bottom surfaces are each delimited on, for example, four sides by carton sides, which represent lateral boundaries of the halves. Therefore, these two halves may be filled, for example, with the containers to be boxed. The two halves have one common longitudinal side, which is bent (approximately) in the middle in the open state. The two halves may be closed. Preferably, the closing is carried out about an axis which runs (approximately) through the middle of the common longitudinal side.

In various embodiments, the length of the longitudinal side is defined by one side of the bottom surface, and is preferably greater than the length of the other side of the bottom surface defining the length of the other carton side, which is referred to as the transverse side and which (approximately) encloses a right angle with the longitudinal sides and the bottom. A long common longitudinal side can render the connection between the two halves stable. There also exist embodiments, however, in which the longitudinal side is shorter than the transverse side.

Stiffening flaps are provided on the transverse sides, which are each formed as an extension of portions of the transverse side or of the whole transverse side. When in straight alignment, they project over the height of a longitudinal side and/or half the height of the common longitudinal side and/or a portion of a longitudinal side of a respective half Each stiffening flap comprises an inner side and an outer side, the outer side designating the side of the stiffening flap which is oriented in the outward direction when in the upright state, while the inner side is oriented in the upright state such that it is oriented in the direction of one half of the packing carton.

The stiffening flaps are foldable into the interior of the packing carton, so that they project into the interior of the carton. Thus, the inner side is then advantageously oriented towards a bottom surface of one of the halves. In this case, the stiffening flap extends approximately parallel to a bottom surface of the carton. In the present description the term "approximately parallel" indicates that the deviation from a parallel course of the stiffening flap and the bottom surface is not great, that is, the two planes, which are defined by one of them covering the bottom surface and the other one covering the stiffening flap, together enclose an angle of an amount of not more than 40° or 30° or 20° or 10°.

Additionally, the packing carton preferably has a longitudinal side designated as an external or outer longitudinal side, with portions of this longitudinal side or the whole longitudinal side being extended. In the context of the longitudinal sides "external" or "outer" simply means that a longitudinal side is concerned which is parallel to the common longitudinal side, but which is not identical with the common longitudinal side. If the carton is open, an outer longitudinal side is then on the outside. In the upright state the extension(s), if oriented as an extension of the longitudinal side, is/are (clearly) higher than a portion of the longitudinal side and/or a longitudinal side of one of the halves and/or the height of the half of the common longitudinal side. The packing carton areas at a longitudinal side which project over the common longitudinal side or over a part or parts of a longitudinal side will be referred to as closing side(s) in the following.

When the packing carton is in the closed state, the outer sides of two stiffening flaps, which are located at two different halves of the carton in the opened state, rest on each other. In the closed state, the stiffening flaps project into the interior of the carton and are configured for joining by a closing agent. Here, and in the following, closing agents include, for example and without limitation, glue, hot glue, adhesives, hot adhesives, adhesive fixing tape, and fasteners with metal or plastic connectors, such as staples. In the closed state, the closing side rests on the other outer longitudinal side. The other longitudinal side is, in this case, the outer longitudinal side not comprising the closing side.

In various embodiments, when the packing carton is in a closed state, the outer sides of two stiffening flaps, which are provided by different carton halves, are joined by a closing agent, e.g. an adhesive, glue, hot glue, a hot adhesive, or by any other suitable closing agent or device.

The packing carton (opened or closed) may be filled with stand-up pouches, with the stand-up pouches being provided in each half. The stand-up pouches preferably lie in the respective halves and have the bottom pointing at the common longitudinal side. The stand-up pouches in different halves thus have their bottoms pointing at each other. The stand-up pouches may be foil pouches. The stand-up pouches may be filled with beverages.

In various embodiments, the closed packing carton is filled with stand-up pouches.

In another embodiment, the packing carton material includes solid board, which is not as stable as corrugated cardboard, despite the same weight, but may be used for a carton according to the invention because the stiffening flaps provide the solid board additional stability for stacking and for transport purposes. Solid board has substantially no voids, unlike corrugated cardboard. Solid board preferably has a material thickness of more than 0.5 mm or 1 mm or 2 mm, and less than 5 mm or 2.5 mm. Solid board is easier to handle than corrugated cardboard. It is less sensitive to impact and can be stacked practically up to any stacking height, yet in a compact and space-saving manner. The advantages of solid board may be utilized for a packing carton according to various embodiments of the invention. Optionally, a single layer of solid board may be used for a packing carton according to other embodiments of the invention. But also such embodiments are possible where parts of the open packing carton are provided as double layers, thus being reinforced. In this respect, it should be additionally noted that in a packing carton material including solid board, additional parts may also be incorporated, which can provide for additional positive material properties. For example, there may be provided a tear thread made of a plastic material in the solid board. Also, threads or strips or inserts made of a solid plastic material may be provided in some embodiments to increase stability.

A machine according to an embodiment of the invention for closing a packing carton is described below. In particular, it is configured to close a packing carton according to an embodiment of the invention, but may also be used for closing other types of packing cartons. In particular, it is also suited to carry out the steps of a method according to an embodiment of the invention. Thus, each step carried out by the machine may also represent a step in an embodiment of the method according to the invention.

A machine according to an embodiment of the invention comprises a conveyor, such as a feeding device 19, which is capable of conveying the packing carton through the machine. The packing carton is then preferably already filled with a product or other containers. The packing carton may be filled, for example, with foil pouches, such as stand-up pouches.

The machine further comprises one, two or more parts, referred to below as pre-folding devices, which are configured to fold over the stiffening flaps placed in front with respect to the direction of movement of the packing carton towards the inside of the packing carton during transport. The pre-folding devices may be configured, for example, as wedges and, and in which case they may be called pre-folding wedges. Advantageously, the pre-folding devices configured, for example, as wedges, may be tapered in the front so as to avoid the packing carton from being easily damaged as the stiffening tabs are folded over.

The embodiment machine further comprises one, two or more movable auxiliary means, e.g. in the form of an upwardly and downwardly movable bow, a rotatably mounted wedge or plate, or similar form, which are configured to fold over the stiffening flaps in the rear of the packing carton, with respect to the direction of movement, towards the inside of the packing carton. The direction of movement is, in this context, the direction into which the conveyor guides the packing carton during a normal closing operation. If front and rear stiffening flaps are mentioned in the following, this may refer to the stiffening flaps placed in the front and in the rear of the packing carton with reference to the direction of movement. Advantageously, the packing carton is preferably conveyed in a direction parallel to its longitudinal sides during a normal closing operation. Advantageously, these auxiliary means are movable in such a way that they are capable of stabilizing the stiffening flaps placed in the rear in the downwardly folded state until the stiffening flaps can be stabilized by another portion of the machine. In embodiments in which the pre-folding device(s) is/are tapered in the front, the auxiliary means may be rotatable, for example, to arrive underneath the tapered portion, thus stabilizing the stiffening flaps placed in the rear until they can be held in their position by the pre-folding device.

The machine also comprises one, two or more folding aids, which are capable of folding the two halves of the packing carton into a position in which the bottom surfaces of the packing carton enclose an angle of approximately 90°, or between 75° and 105° or between 45° and 135°.

The embodiment machine further comprises one, two or more folding devices, each of which may be configured as the same component as a pre-folding device, or as a separate component, and against which the stiffening flaps of the packing carton can be pressed so that the stiffening flaps extend afterwards approximately parallel to the bottom surface of the packing carton. The pressing allows for folding of the stiffening flaps over and/or aligning them. The meaning of the term "approximately parallel" is, in this context, the same as the one discussed above in the context of a packing carton according to the invention. For example, if the pre-folding devices are configured as pre-folding wedges, and the folding devices are the same component as the pre-folding devices, the pre-folding devices may be configured in such a way that the stiffening flaps are oriented approximately parallel to the bottom surface of the packing carton by side faces of the pre-folding wedges.

The embodiment machine also comprises one or two movable nozzles, which are suited to apply a closing agent, e.g. in the form of a closing agent trace, to two stiffening flaps placed on different transverse sides, successively or simultaneously. The closing agent trace may include or be formed as a continuous closing agent trace and/or a trace of closing agent droplets or points and/or discontinuous closing agent areas. A closing agent may also be applied, for example, in the form of individual, e.g. punctiform or planar, coatings. Preferably, one coated stiffening flap is placed in the front with respect to the direction of movement, and one coated stiffening flap is placed in the rear with respect to the direction of movement. The nozzle(s) is/are advantageously arranged to apply closing agent to two stiffening flaps that join transverse sides of the same half of the packing carton. Preferably, the application of the closing agent is accomplished while the packing carton is in a position in which the two bottom surfaces of the packing carton enclose an angle of approximately 90°, or between 75° and 105° or between 45° and 135°. In this position, the stiffening flaps can be prevented from folding back to their starting position by two flaps, which oppose each other on different halves, mutually preventing each other from folding back into the starting position.

The machine further has a closing capability, in which the packing carton can then be closed completely, and components for guiding the packing carton out of the machine.

In addition, it may be possible in some embodiments to additionally arrange the movable auxiliary means in a lowered position when initially introducing the packing carton into the machine, so that they are capable of pre-breaking the stiffening flaps placed in front as the packing carton is conveyed underneath the auxiliary means, and are subsequently moved in such a way that they are capable of folding over the stiffening flaps placed in the rear.

In one embodiment, the nozzle(s) applies/apply a closing agent to the stiffening flaps from the inside to the outside in such a way that the closing agent is as fresh as possible when the packing carton is closed. In this case, "from the inside to the outside" means that the relative direction of movement of the nozzles relative to the stiffening flaps runs such that the application of the closing agent starts at a position of the stiffening flaps which is closer to the common longitudinal side of the packing carton halves than the position at which the application of the closing agent ends. In particular, this may mean that two nozzles are movably arranged in such a way that they can apply a closing agent coating, which is applied to two stiffening flaps of one half of the packing carton in such a way that it extends from a side of a stiffening flap facing the common longitudinal side of the two halves to a side of the stiffening flap that is located closely to an outer longitudinal side of one of the two halves.

In some embodiments, an additional nozzle for a closing agent is provided, which is capable of providing a longitudinal side of the packing carton with a closing agent coating, wherein the longitudinal side provided with the closing agent coating is an outer longitudinal side, and the other outer longitudinal side comprises a closing side. Then, during the closing, the closing side of the other longitudinal side will rest on this longitudinal side provided with a closing agent coating. Thus, the packing carton can be closed on the longitudinal side.

In some embodiments, the machine comprises one, two or more folding aids whose surface inclination(s) is/are configured such that the folding aid or the combination of folding aids predefine the desired opening angle by means of the surface inclination, so that the packing carton on these folding aids is automatically placed in the position in which the bottom surfaces of the two halves enclose an angle of approximately 90°, or between 75° and 105° or between 45° and 135°. Optionally, each of these folding aids may also be movable vertically, individually or with one or more other folding aids together, so as to allow an upward movement of the packing carton. Two folding aids can be arranged, for example, such that the planes in which the two surfaces lie relative to each other enclose the intended folding angle of approximately 90°, or between 75° and 105° or between 45° and 135°.

In some embodiments, the machine comprises two or more plates, which are movable horizontally towards each other and apart from each other, and by means of which the pressing of the packing carton with the stiffening flaps against the folding devices can be realized. The arrangement of the plates may also be described as a type of press. Depending on the embodiment, they may be regarded as folding aids or as independent machine parts. In different embodiments, they may be provided in combination with the above-described folding aids or without them.

In other embodiments, the machine comprises two or more plates by means of which the packing carton can be pressed together for closing the packing carton. They may be configured as the same plates as the above-described plates or as other/additional plates. Similar to the plates described in the previous paragraph, these plates are arranged to be movable horizontally. Optionally, a plate may cover the surface area of the basic area of the bottom surface of the packing carton, or a surface area smaller than the basic area of the bottom surface of the packing carton, or a basic area larger than the bottom surface of the packing carton.

In some embodiments, the machine comprises a pressing device, by means of which pressure is generated from above after the packing carton is closed in order to distribute the closing agent between the closing side and the longitudinal side coated with the closing agent by means of pressure and bring the closing agent into good contact with the longitudinal side and the closing side.

In some embodiments, the folding device(s) and the nozzle(s) with the closing agent are arranged in two successive stations provided by a conveyor, e.g. a feeding device 19. This allows a simultaneous treatment of a packing carton by the folding device(s) and of another packing carton by the nozzle(s) and the closing agent, and may thus serve to accelerate the execution of the method. In this case, the stations in the machine are arranged such that the station having the folding devices is traversed before the station having the nozzle(s) and the closing agent.

The invention further comprises a method for closing a packing carton, in particular a packing carton according to an embodiment of the invention, by a closing machine, in particular by a machine according to an embodiment of the invention. An embodiment of the method may comprise the execution of the steps using an embodiment of the machine according to the invention. Other embodiments of the method may be realized using portions of an embodiment of a machine according to the invention. Vice versa, auxiliary means used for the method may also be used in embodiments of a machine according to the invention.

A method according to an embodiment of the invention includes several steps. It includes the step of folding over the stiffening flaps placed in front with respect to the direction of movement, preferably by one, two or more parts designated as pre-folding devices, and of folding over the stiffening flaps placed in the rear with respect to the direction of movement, preferably by one, two or three movable auxiliary means. The method further comprises folding the two halves, so that their bottom surfaces enclose an angle of approximately 90°, or between 75° and 105° or between 45° and 135°.

The method further comprises pressing the packing carton, including the stiffening flaps, against one or more folding devices, so that the stiffening flaps then extend approximately parallel to the bottom surfaces of the packing carton. The meaning of the term "approximately parallel" has already been explained in connection with the packing carton. The method further comprises applying a closing agent, e.g. in the form of a closing agent trace, to the outside of two stiffening flaps. The closing agent trace may include or be formed as a continuous closing agent trace and/or a trace of closing agent droplets or points and/or discontinuous closing agent areas. A closing agent can also be applied, for example, in the form of individual, e.g. punctiform or planar coatings. Preferably, one coated stiffening flap is placed in front with respect to the direction of movement, and one coated stiffening flap is placed in the rear with respect to the direction of movement. The closing agent coating(s) can be accomplished by a nozzle or nozzles, or any other dosing means for applying the closing agent. Advantageously, the nozzle(s) may be arranged to apply closing agent to at least two stiffening flaps that join the transverse sides of the same half of the packing carton.

The method may further comprise closing the packing carton, where the outer sides of a stiffening flap coated with closing agent and of a stiffening flap comprised by the other packing half are contacted and fixed to each other by the closing agent.

In a preferred embodiment, the method of folding over the front stiffening flaps and of pressing against one or more folding devices is carried out by means of one or more like components. For example, the folding device and the pre-folding device are configured as a single component, or that a folding device and a pre-folding device are each configured as a respective component.

In another embodiment, the pressing of the packing carton, including the stiffening flaps, comprises pressing the stiffening flaps inwardly along the entire length. As described above, they extend approximately parallel to the bottom surface of the packing. It may be an advantage of this embodiment that stiffening flaps which were pressed inwardly along the entire length do not fold back into the starting position so easily afterwards and, therefore, remain more stably in the position approximately parallel to the bottom surfaces. The meaning of "approximately parallel" has already been explained with respect to the packing carton.

Furthermore, the method may also comprise one or more additional steps in some embodiments. Such steps may include, for example, a step of conveying the packing carton in the machine. A step of pre-breaking the stiffening flaps placed in the front of the packing carton with respect to the direction of movement may also be included in the method. This is an additional step in which the stiffening flaps are pre-broken prior to folding them over. Also a step of conveying into a station may be part of an embodiment method. This step may comprise folding over the stiffening flaps. Folding the two halves of the packing carton together such that their bottom surfaces enclose an angle of approximately 90°, or between 75° and 105° or between 45° and 135 may then be carried out in the station. A conveying step into another station, too, may be comprised in the method. For example, the packing carton may be closed in this other station. Also the method may further comprise a step of conveying the packing carton out of the machine.

BRIEF DESCRIPTION OF THE DRAWINGS

Other embodiments will be explained by means of the figures. In the figures.

DETAILED DESCRIPTION OF THE PREFERRED EMBODIMENTS

Figure 1:
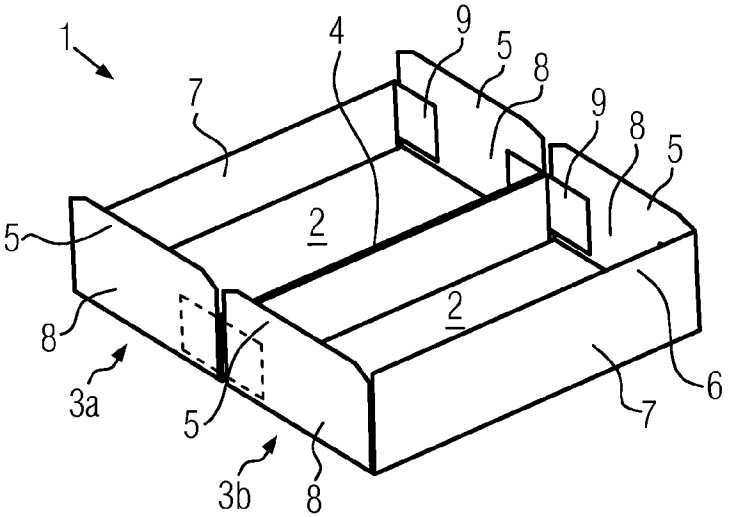
FIG. 1 shows an embodiment of a packing carton in an open state.

FIG. 1 shows an embodiment of a packing carton 1 in an open state. When the packing carton 1 is in the open state it comprises two halves 3*a* and 3*b* which stand on bottom surfaces 2. The two halves 3*a* and 3*b* are connected by one common longitudinal side 4, which is bent in the middle while in the open state. This embodiment of a packing carton 1 further comprises two longitudinal sides 7. In this embodiment, a closing side 6 is provided on a longitudinal side 7 of the packing carton as an extension of the longitudinal side 7. Other embodiments may also be formed without a closing side 6 (not shown). The packing carton 1 further comprises four transverse sides 8 in whose extensions the stiffening flaps 5 are provided in this example. In other embodiments it is also possible, however, that both the closing side 6 and the stiffening flaps 5 of such an embodiment are provided only on portions of the longitudinal side 7 or the transverse sides 8 (not shown). Also, embodiments where closing sides 6 are provided on portions of both longitudinal sides 7 are possible within the limits of the invention claimed (not shown). The stiffening flaps 5 comprise two sides, of which one points away from the packing carton in the upwardly oriented state and is referred to as outside, while the other points to the packing carton half and, therefore, is referred to as inside. The stiffening flaps 5 can be folded in the direction of the interior of the carton 1.

The fixing of the longitudinal sides 7 to the transverse sides 8 may be realized, for example, by flaps 9. In this case, the flaps 9 are fixed to the transverse sides 8 by a closing agent and represent bent extensions of the longitudinal sides 7. But also a fixing of flaps that represent an extension of the transverse sides 8 and are connected to the longitudinal sides 7 is possible in other embodiments. Mixing the embodiments is possible, too. The connection of the longitudinal sides 7 and the transverse sides 8 by means of flaps 9 may provide the carton 1 with additional stability. Embodiments where the packing carton 1 is folded from other basic shapes are possible as well, for example, where the packing carton 1 has a double layer on portions of sides or on entire sides (not shown).

As can be seen in FIG. 1, both halves 3*a*, 3*b* of packing carton 1 according to the invention may be filled with containers. The two halves 3*a*, 3*b* have an approximately identical volume to be filled, which may be defined, for example, by a product of the bottom surface 2 and the height of half of the common longitudinal side 4. In this example, the height of the common longitudinal side 4 may be defined, for example, by the shortest connection from the bottom side to the bent edge in the middle of the common longitudinal side 4.

The carton 1 according to an embodiment of the invention may be made of any material having sufficient stability. As the stiffening flaps provide additional stability to the closed packing carton during stacking or transport, the packing carton material may also comprise solid board in addition to or instead of corrugated cardboard. Also, these materials may comprise additional elements, such as tear threads or plastic reinforcements. In some embodiments each packing carton side comprises a layer of solid board. In other embodiments one or more sides or side parts are reinforced by another layer of the same or another material. In some embodiments the bottom sides may be reinforced by an insert of a reinforcing material, which may include the same material as the packing carton material or another material.

FIG. 2 shows an embodiment of a packing carton 1 according to the invention in the closed position.

Figure 2B:
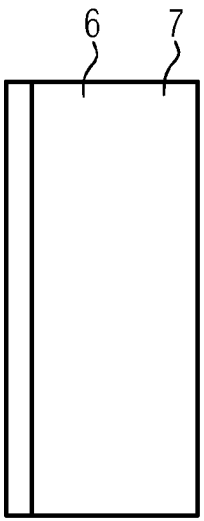
FIGS. 2*a* and 2*b* show an embodiment of a packing carton according to the invention in the closed state.
Figure 2A:
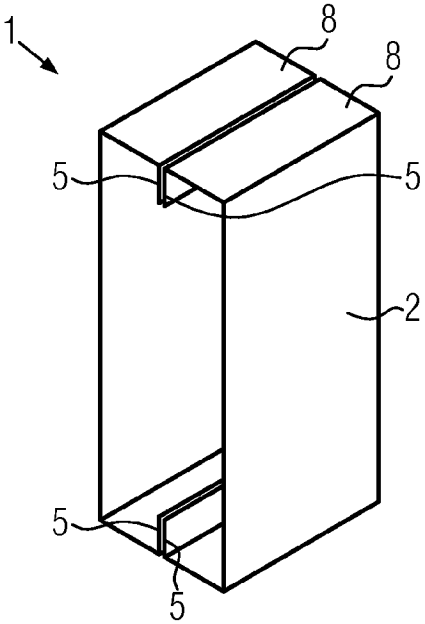

FIG. 2*a* thereof shows a cross-section of the closed packing carton parallel to the longitudinal sides 7. It can be seen that the stiffening flaps 5 of this example, in the closed state, project into the interior of the packing carton and that two stiffening flaps contact each other on their outer sides.

The stiffening flaps 5 are oriented to the transverse sides 8 approximately at a right angle. They provide the closed packing carton with the necessary stability for transport and stackability. The transverse sides 8 are shown at the top of this illustration, while the bottom surface 2 is now located at the side. Based on the symmetry it can be seen why the fillable volume of the packing carton 1 is twice as large as the fillable volume of one half 3*a*, 3*b*.

FIG. 2*b* shows a closed packing carton, with a vertical top view of the longitudinal sides 7, with the closing side 6 which is provided in some embodiments. In this example, the closing side 6 is slightly shorter than the longitudinal side 7 in order not to wholly cover the longitudinal side 7 lying underneath thereof in the closed state. In other embodiments the closing side 6 may also wholly cover the longitudinal side 7 lying underneath it (not shown). The closing side 6 rests with its inside on the outside of the longitudinal side 7, of which it does not constitute an extension in the open state.

Figure 3B:
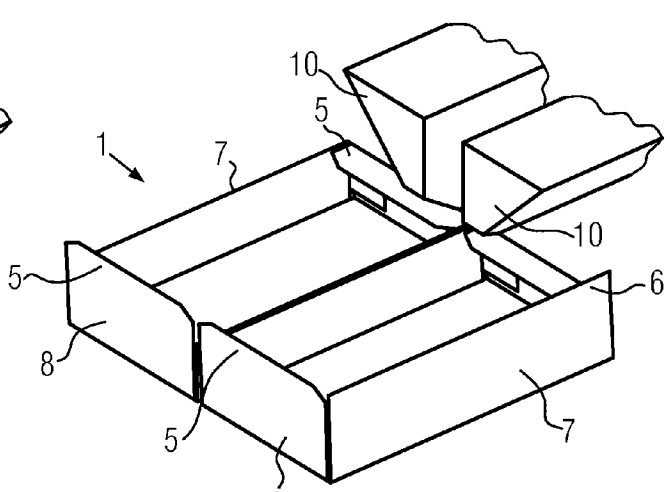
FIGS. 3*a*-3*c* show various steps of an embodiment of a method and related machine according to the invention.
Figure 3A:
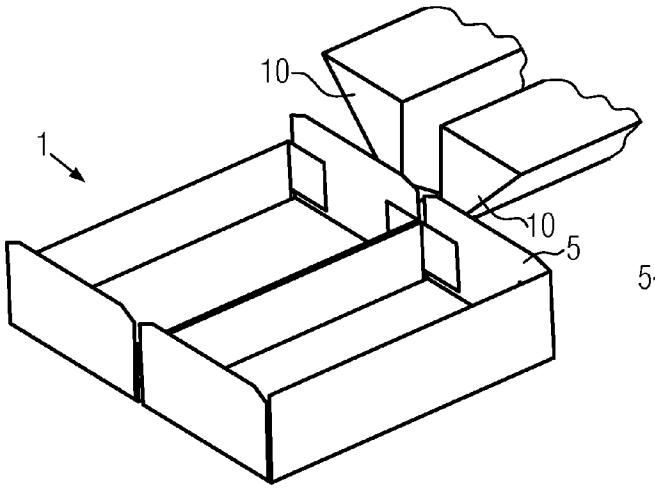
Figure 3C:
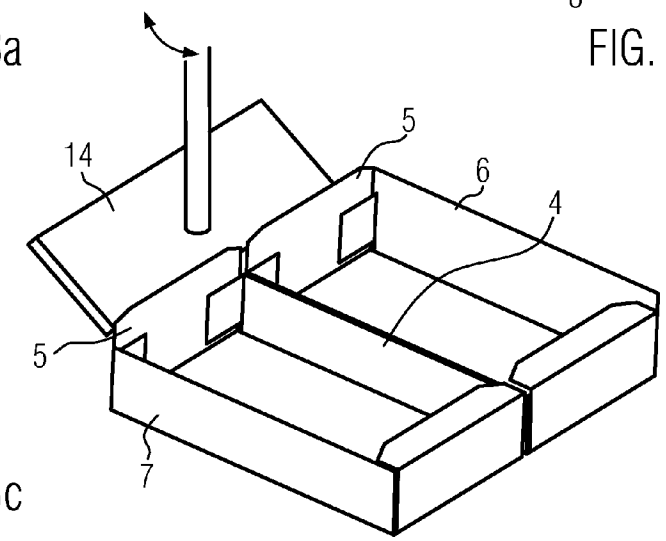

FIGS. 3*a*-3*c* show various steps of an embodiment of the method according to the invention, in this example using an embodiment of a machine according to the invention and a packing carton according to an embodiment of the invention.

FIG. 3*a* shows a step of folding the stiffening flaps 5 placed in the front with respect to the direction of movement of packing carton 1. In the example shown, this folding is accomplished by two pre-folding devices 10 which are configured as pre-folding wedges 10. The pre-folding wedges 10 may, in this case, be tapered in the front, so that the folding of the stiffening flaps 5 is carried out gradually. Thus, damage to the stiffening flaps 5 during the folding step is prevented.

FIG. 3*b* shows a step during further transport of the packing carton 1, after the folding of the front stiffening flaps 5, in the same machine as shown in FIG. 3*a*. While the two pre-folding wedges 10 of this example keep the stiffening flaps 5, which are positioned in front with respect to the direction of movement, pressed down at the positions where the pre-folding devices 10, which in this example are configured as pre-folding wedges 10, lie on the stiffening flaps 5, the packing, which, in this example, is illustrated as an embodiment of a carton 1 according to the invention, is conveyed further. This conveyance is realized, for example, by a feeding device 19. It can be seen in FIG. 3*b* that, in this example, the closing side 6 is not folded over by the two pre-folding devices 10.

FIG. 3*c* shows a possible arrangement of an auxiliary means 14 of a machine according to an embodiment of the invention, which is configured to fold the stiffening flaps 5, which are positioned in the rear with respect to the direction of movement, towards the inside of the packing carton. FIG. 3*c* shows another embodiment of a packing carton 1 according to the invention, which has the closing side 6 on the other outer longitudinal side, as compared to the cartons of FIGS. 3*a* and 3*b*. The step of folding over the stiffening flaps 5 placed in the rear, which are shown as still being upright in FIG. 3*c*, may also be carried out in embodiments of a packing carton according to the invention, however, that do not have a closing side 6 or have a closing side 6 on the other longitudinal side 7. By pivoting the movable auxiliary means 14, which may be configured in the form of a rotatably mounted, driven plate or bow, like in this example, the rear stiffening flaps are folded over into the interior of the packing carton. Advantageously, the plate may be arranged such that it can be rotated to arrive underneath the tapered portion of the pre-folding device 10, so that the stiffening flaps 5 placed in the rear with respect to the direction of movement are first bent and stabilized by the auxiliary means 14, and are then kept down by the pre-folding devices 10.

The auxiliary means 14 may be movable in several directions. For example, there also exists an embodiment in which the auxiliary means 14 is configured as an obliquely mounted plate or wedge which may be rotatable, on the one hand, and wherein the inclination of the plate/wedge is, on the other hand, such that in some embodiments this auxiliary means can be arranged during the transport of the packing carton into the machine in a position in which it is capable of pre-breaking the front stiffening flaps, and in which the auxiliary means 14 can be moved in the continued operation by rotation or the like such that it is capable of folding over the rear stiffening flaps.

After the stiffening flaps 5 placed in the rear with respect to the direction of movement have been folded over by auxiliary means 14, they may also arrive underneath the pre-folding devices 10 because they are located at the same height as the stiffening flaps 5 that are placed in the front with respect to the direction of movement and are folded over by the pre-folding devices 10. Thus, the packing carton can be conveyed further in the machine, even underneath the pre-folding devices. For example, in the case where the pre-folding devices 10 are also configured as folding devices, a position can thus be obtained which corresponds to the position shown in FIGS. 4*a*-4*d* and in which the steps shown in FIGS. 4*a*-4*d* can be carried out. As soon as the folded stiffening flaps 5 positioned in the rear with respect to the direction of transport have been conveyed to arrive underneath the pre-folding devices 10, they may also be stabilized by the pre-folding devices 10 in their folded position.

FIGS. 4*a*-4*d* show various steps of an embodiment of the method using a machine, in this example a machine according to an embodiment of the invention, and a packing carton, in this example represented by a packing carton according to an embodiment of the invention. During the steps illustrated in FIGS. 4*a*, 4*b* and 4*c*, the folding devices which, in this example, are configured as pre-folding wedges 10, are advantageously always in contact with the stiffening flaps 5 in at least one area such that they stabilize the stiffening flaps 5 approximately parallel to the bottom surface 2 of the packing carton.

Figure 4C:
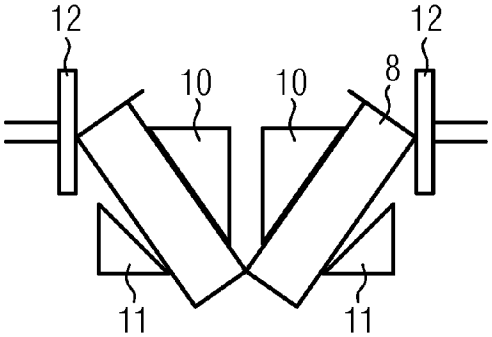
FIGS. 4*a*-4*d* show further steps of an embodiment of the method and related machine according to the invention.
Figure 4B:
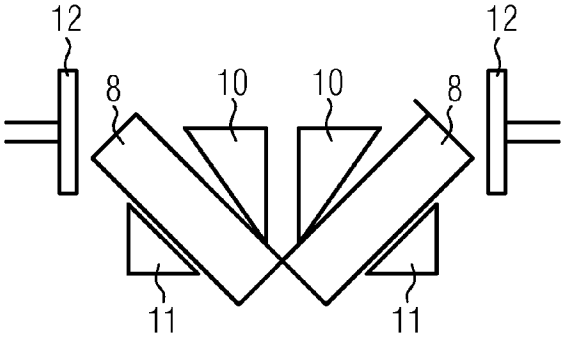
Figure 4A:
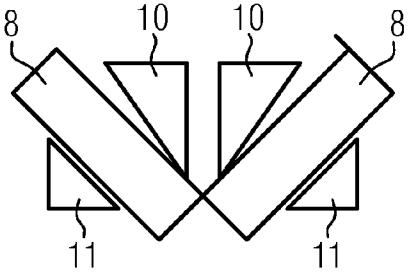

FIG. 4*a* shows the packing carton, the two halves of which have already been folded such that they enclose an angle of approximately 90°, or between 75° and 105° or between 45° and 135°. Two folding aids 11 are visible, which stabilize the packing carton in its position. On the upper side of the packing carton there are provided two folding devices configured, in this example, as pre-folding wedges 10. Preferably, the stiffening flaps 5 are here stabilized by the lower tips of the folding device which is configured as a pre-folding wedge 10.

FIG. 4*b* shows two plates 12, which can be moved horizontally towards each other and which, in FIG. 4*c*, press the two halves of the packing carton against a flat side of the pre-folding wedges 10. In doing so, the stiffening flaps 5 are oriented approximately parallel to the bottom surfaces 2. Preferably, they are pressed against the respective sides of the pre-folding wedges 10 along the entire length, whereby the area in which the folding device contacts the packing carton may change.

Figure 4D:
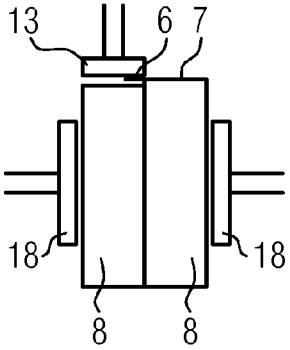

FIG. 4*d* shows the packing carton in the closed position. For this purpose the packing carton, in this case a packing carton according to the invention, has been conveyed further after the step shown in FIG. 4*c* either to a next station, which may, for example, be referred to as a closing station, so that the folding device(s), which is/are configured as pre-folding wedges 10 in this example, does/do not prevent the packing carton from being closed. Alternatively, the folding device(s) may have been removed. To this end, the folding devices may be mounted, for example, to be movable vertically or horizontally. The step of conveying the packing carton further into a next station or of removing the folding device(s) may be part of some embodiments of a method, and may be carried out by a correspondingly configured portion of a machine according to the invention.

For closing the packing carton, the packing carton is, in this example, pressed together by two horizontally movable plates 18, whereby the stiffening flaps 5 rest in the interior of the packing carton (see for example FIG. 2). Equally shown is the pressing device 13, which may be optionally provided in a machine according to the invention, which may be movable vertically and which may generate pressure from above by plate 13 after the packing carton was closed, so as to distribute a closing agent by means of pressure and bring it into good contact with the longitudinal side 7 and the closing side 6.

After the method step shown in FIG. 4*d*, the packing carton may be conveyed out of the machine according to an embodiment of the invention (not shown).

Figure 5B:
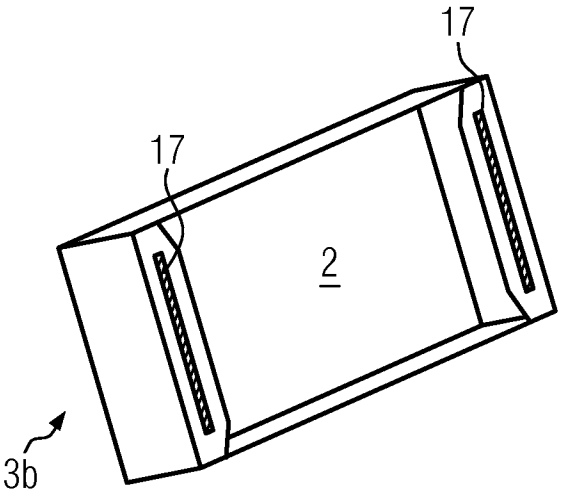
FIGS. 5*a* and 5*b* show further steps of an embodiment of the method and related machine according to the invention.

FIG. 5 shows a step of applying a closing agent to the outer side of two stiffening flaps 5 on a packing carton half 3*b*. In other embodiments the closing agent may also be applied to other stiffening flaps (not shown). In some embodiments, the packing carton half 3*b* may comprise a closing side 7, while in other embodiments a closing side 7 is provided on packing carton half 3*a*, or not at all. The embodiment in which the packing carton half 3*b* comprises a closing side, and which is shown herein, may be advantageous in some situations. Applying the closing agent to two stiffening flaps 5, which are located on the same packing carton half 3*b* as the closing side 7, may be advantageous, for example, since a simultaneous application of closing agent to the outer longitudinal side of carton half 3*a* can thus be simplified by a glue trace (not shown). The glue trace may be a continuous one, and/or include or be formed as a trace of glue droplets and/or discontinuous glue areas or individual glue areas. The second packing carton half 3*a* is not illustrated. The packing carton is illustrated up to the common longitudinal side 4, which is drawn up to the bend.

In this step, the stiffening flaps 5 are already located in an approximately parallel position relative to the bottom surface 2. In this example, the step of applying a closing agent is carried out by means of two nozzles 16, which may be provided in some embodiments of a machine according to the invention. Preferably, the nozzles 16 are arranged movably. Preferably, they are configured to apply a closing agent to both stiffening flaps 5 of packing carton half 3*b*, beginning at the side that is closer to the common longitudinal side 4. In the example shown in FIG. 5*b* the closing agent is applied in the form of a closing agent trace 17. The closing agent trace may include or be formed as a continuous closing agent trace and/or a trace of closing agent droplets or points and/or discontinuous closing agent areas. The closing agent can also be applied, for example, in the form of individual, for example, punctiform or planar coatings.

If the packing carton is now closed, as is shown, for example, in FIG. 4*d*, two stiffening flaps 5 rest against each other with their outer sides, adhering together, and project into the interior of the carton, as is shown in FIG. 2*a*. Thus, they stabilize the packing carton in the closed state, which packing carton is exemplarily shown in the figures as a packing carton 1 according to an embodiment of the invention.

Figure 6:
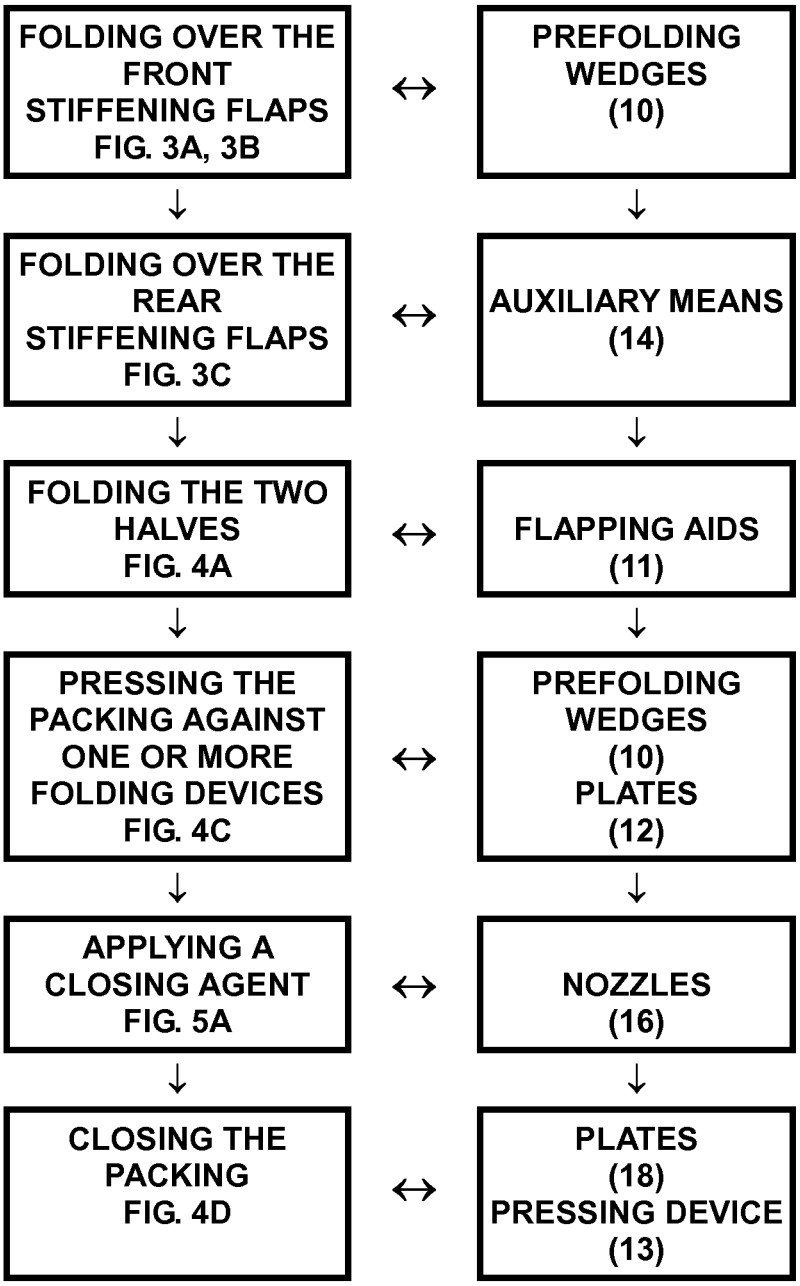
FIG. 6 illustrates execution of the method steps.

FIG. 6 illustrates execution of various method steps of an embodiment of a method according to the invention, with reference to other figures explaining the steps. Additionally, some portions of a related embodiment machine are referenced in FIG. 6, which correspond to the method steps in an exemplary embodiment. Other embodiments including further steps and/or using other machine portions or only some of the machine portions shown in the figures so far are also part of the invention, however.

Figure 5A:
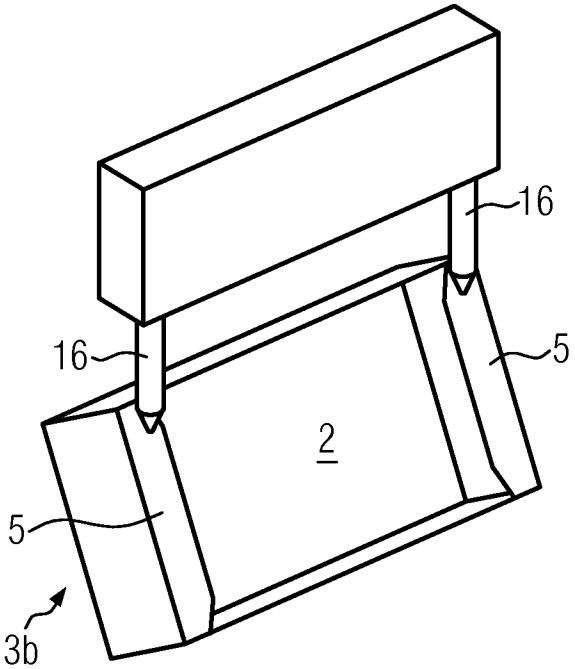

The first step of an embodiment method comprises the folding of the front stiffening flaps 5, which can be seen in FIGS. 3*a* and 3*b*. This is carried out, for example, using the pre-folding wedges 10. Another step comprises the folding of the rear stiffening flaps 5. In the example shown herein this step may be carried out by using the auxiliary means 14, which can be seen in FIG. 3*c*. In another step the two halves 3*a* and 3*b* are folded such that their bottom surfaces 2 enclose an angle of approximately 90°, or between 75° and 105° or between 45° and 135°. FIG. 4*a* shows the packing carton already being in the desired position. It also shows the folding aid(s) 11. In this example, two folding aids 11 are shown, whose surface inclination encloses, for example, an angle of approximately 90°. Later, the packing carton is pressed against one or more folding devices, as shown in FIG. 4*c*. In this example, the pressing is carried out by plates 12, which press the packing carton against flat faces of the pre-folding wedges 10. In other embodiments the pressing may also be carried out solely by the folding aids 11, so that the plates 12 are not necessary in some embodiments. In another step a closing agent is applied, an example of which is shown in FIG. 5*a*. The embodiment of the machine shown in FIG. 5*a* comprises two nozzles 16. In a next step the packing carton is closed. The closed packing carton is shown in FIG. 4*d*, together with the portions of the machine of FIG. 4*d* used for the closing are the plates 18 and the pressing device 13.

Figure 7:
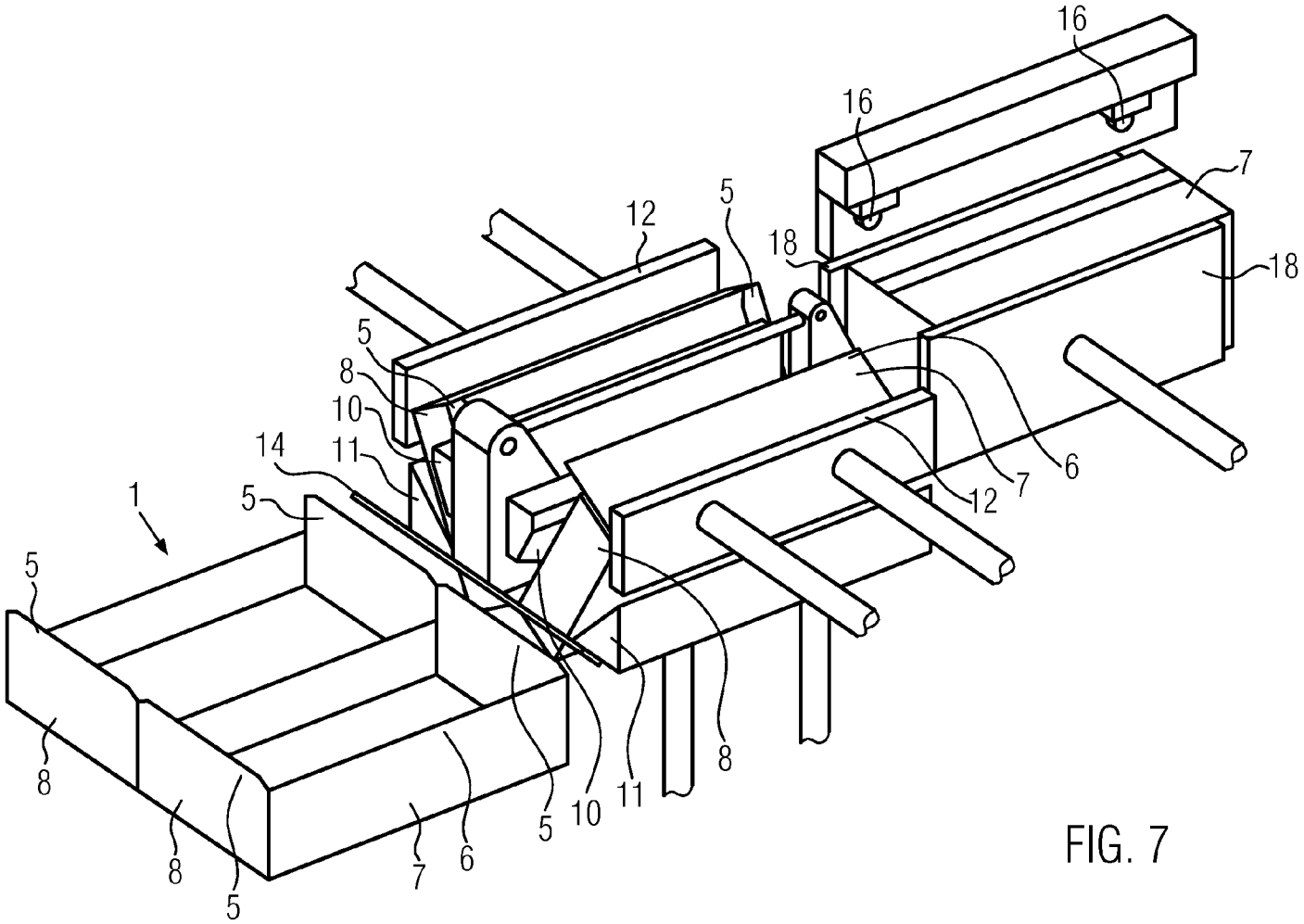
FIG. 7 shows portions of an embodiment of a machine according to the invention.
Figure 8:
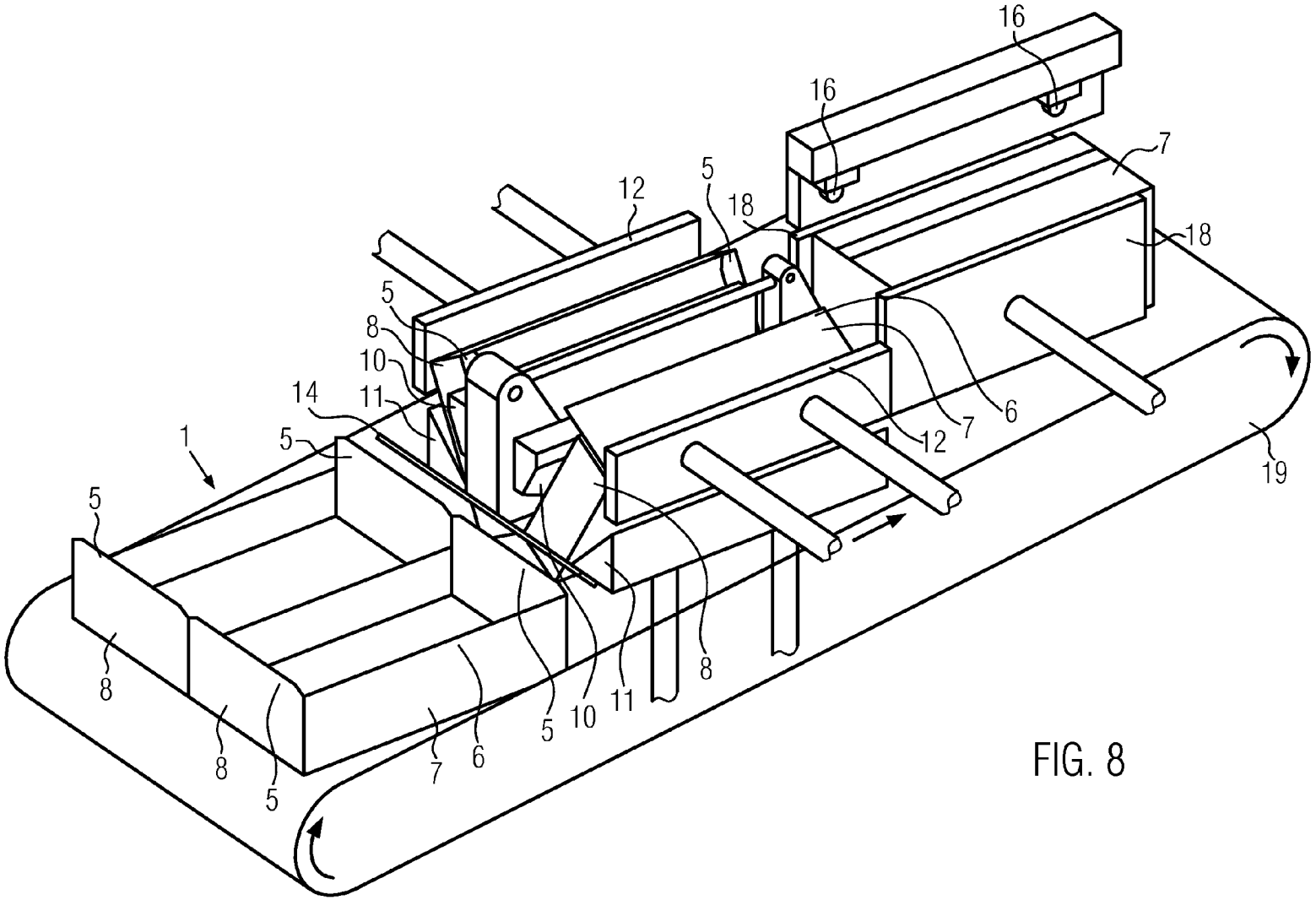
FIG. 8 shows portions of an embodiment of a machine according to the invention.

FIGS. 7 and 8 illustrates portions of an embodiment of a machine according to the invention for closing a packing carton. In these illustrations, a possible sequence of steps of an embodiment of a method according to the invention can be recognized. The packing carton 1 is conveyed in a forward direction into the machine for closing the packing carton 1. Thus, the stiffening flaps 5 are pre-broken by the auxiliary means 14 during the forward conveyance. During further conveyance, the pre-broken stiffening flaps 5 arrive underneath the pre-folding devices which, in this example, are configured as pre-folding wedges 10. While the front stiffening flaps 5 have already been folded over in a downward direction by the pre-folding devices, the auxiliary means 14, which, in this example, is rotatably mounted, can be brought into a position from which it folds over the stiffening flaps 5 placed in the rear with respect to the direction of movement as the auxiliary means 14 rotates in the direction of the pre-folding devices. While the auxiliary means 14 is moved in the direction of the pre-folding devices 10, the stiffening flaps 5 in the rear are thus folded over. The auxiliary means 14 may be mounted to arrive underneath the tapered portions of the pre-folding devices 10 during the rotation operation, allowing the auxiliary means 14 to stabilize the rear stiffening flaps 5 in the folded position until the rear stiffening flaps 5 rest underneath the pre-folding devices 10. The forward conveyance may be carried out, for example, by a conveyor such as feeding/pushing device 19.

Once the packing carton is located underneath the pre-folding devices, the vertically movable folding devices 11, which move in this case, for example, from the bottom to the top, can transfer the packing carton into a position in which its bottom surfaces enclose an angle of approximately 90°, or between 75° and 105° or between 45° and 135°. The folding devices 11 may be arranged, for example, such that they extend on the right and left of the conveyor belt.

Subsequently, the packing carton can be pressed against the folding device by the movable plates 12 which, in this case, are configured as the same component as the pre-folding device 10. Preferably, the stiffening flaps 5 are here folded over inwardly along the entire length.

Next, the packing carton can be conveyed further. Subsequently, a closing agent can, in this example, be applied to two outer sides of stiffening flaps 5 by nozzles 16, whereby the application of the closing agent is preferably carried out from the inside to the outside.

The packing carton may then be closed by the two horizontal plates 18. As described, the outer sides of two stiffening flaps 5, which are provided on different packing carton halves or belong to different packing carton halves, rest against each other.

Subsequently, the packing carton can be conveyed out of the machine.

Those skilled in the art will recognize that the present invention has many applications, may be implemented in various manners and, as such is not to be limited by the foregoing embodiments and examples. Any number of the features of the different embodiments described herein may be combined into a single embodiment, the locations of particular elements can be altered and alternate embodiments having fewer than or more than all of the features herein described are possible. Functionality may also be, in whole or in part, distributed among multiple components, in manners now known or to become known.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention. While there has been shown and described fundamental features of the invention as applied to being exemplary embodiments thereof, it will be understood that omissions and substitutions and changes in the form and details of the disclosed invention may be made by those skilled in the art without departing from the spirit of the invention. Moreover, the scope of the present invention covers conventionally known, future developed variations and modifications to the components described herein as would be understood by those skilled in the art.

The invention claimed is:

1. A machine for assembling a packing carton comprising two halves, each half comprising a bottom surface, an inner longitudinal side, an outer longitudinal side, and two transverse sides, the two bottom surfaces connected by a common longitudinal side which is bent in the middle when the packing carton is in an open state to form the inner longitudinal side of each half, each longitudinal side comprising two flaps which are extensions of the longitudinal side and configured to be fixed to adjacent transverse sides, and each transverse side comprising a stiffening flap which is an extension of the transverse side and comprises an inner side and an outer side, the machine comprising:

a feeding device configured to convey the packing carton through the machine;

at least one first folding device configured to fold the stiffening flaps positioned in the front of the packing carton with respect to a direction of movement of the packing carton towards the interior of the packing carton during conveyance of the packing carton so that the inner sides face the bottom surface of the corresponding half, wherein the first folding device comprises two wedges which are tapered in the front, so that the folding of the stiffening flaps is carried out gradually, and wherein the wedges are configured to keep the stiffening flaps positioned in front with respect to the direction of movement pressed down at the positions where the wedges lie on the stiffening flaps while the packing carton is conveyed further;

at least one rotatably mounted, driven plate or bow, which is configured to pivot to fold the stiffening flaps positioned in the rear of the packing carton with respect to the direction of movement of the packing carton towards the interior of the packing carton, and is further configured to rotate underneath the tapered portion of the wedges, so that the stiffening flaps positioned in the rear with respect to the direction of movement are first bent and stabilized by the plate or bow, and are then kept down by the wedges;

at least one folding aid configured to fold the halves of the packing carton into a position in which the bottom surfaces of the halves of the packing carton enclose an angle between 450 and 135°;

at least one second folding device configured to press at least a portion of the packing carton against a flat side of the wedges so that the stiffening flaps are positioned substantially parallel to the bottom surfaces of the packing carton; and at least one movable nozzle configured to apply a closing agent to the outer sides of at least two stiffening flaps positioned on different transverse sides.

2. The machine according to claim 1, wherein the at least one nozzle is configured to apply the closing agent to the stiffening flaps in a direction from the inner longitudinal side to the outer longitudinal side.

3. The machine according to claim 1, further comprising an additional nozzle configured to apply a closing agent to at least one outer longitudinal side of the packing carton.

4. The machine according to claim 3, further comprising a pressing device configured to apply pressure to the packing carton to distribute the closing agent between the outer longitudinal sides.

5. The machine according to claim 1, wherein the at least one folding aid comprises two folding aids configured to fold the halves of the packing carton into a position in which the bottom surfaces of the halves of the packing carton enclose an angle of about 90°.

6. The machine according to claim 1, wherein the at least one second folding device comprises two plates movable horizontally towards each other to press the packing carton against the wedges.

7. The machine according to claim 1, further comprising at least two horizontally movable plates configured to press the halves of the packing carton together to close the packing carton so that the stiffening flaps project into the interior of the packing carton and the outer sides of the stiffening flaps on the different halves of the packing carton rest against each other and are coupled to each other by the closing agent.

8. The machine according to claim 1, wherein the at least one first folding device and the at least one nozzle are positioned in respective successive stations with respect to the feeding device.

9. A method for assembling a packing carton comprising two halves, each half comprising a bottom surface, an inner longitudinal side, an outer longitudinal side, and two transverse sides, the two bottom surfaces connected by a common longitudinal side which is bent in the middle when the packing carton is in an open state to form the inner longitudinal side of each half, each longitudinal side comprising two flaps which are extensions of the longitudinal side and configured to be fixed to adjacent transverse sides, and each transverse side comprising a stiffening flap which is an extension of the transverse side and comprises an inner side and an outer side, the method comprising:

folding the flaps on the longitudinal sides toward the interior of the packing carton, and fixing each longitudinal side flap to the inside of the adjacent transverse side;

folding the stiffening flaps positioned in the front of the packing carton with respect to a direction of movement of the packing carton towards the interior of the packing carton so that the inner sides face the bottom surface of the corresponding half;

folding the stiffening flaps positioned in the rear of the packing carton with respect to the direction of movement of the packing carton towards the interior of the packing carton so that the inner sides face the bottom surface of the corresponding half;

folding the halves of the packing carton towards each other so that the bottom surfaces of the halves of the packing carton enclose an angle between 45° and 135°;

pressing at least a portion of the packing carton against one or more folding devices so that the stiffening flaps are positioned substantially parallel to the bottom surfaces of the packing carton;

applying a closing agent to the outer sides of at least two stiffening flaps positioned on different transverse sides; and closing together the halves of the packing carton so that the outer sides of the stiffening flaps having the closing agent and outer sides of corresponding stiffening flaps on the other half of the packing carton are coupled to each other by the closing agent.

10. The method according to claim 9, further comprising applying a closing agent to at least one outer longitudinal side of the packing carton.

11. The method according to claim 10, further comprising applying pressure to the packing carton to distribute the closing agent between the outer longitudinal sides.

12. The method according to claim 9, further comprising at least one of the following steps:

filling the halves of the packing carton;

conveying a filled packing carton into a folding machine;

conveying the packing carton into an intermediate station of a folding machine, during which the stiffening flaps are folded over, and wherein the halves are open in the intermediate station;

conveying the packing carton into a closing station of a folding machine in which the packing carton is closed.

* * * * *